US006187117B1

(12) United States Patent
Shen et al.

(10) Patent No.: US 6,187,117 B1
(45) Date of Patent: Feb. 13, 2001

(54) METHOD OF MAKING AN AS-ROLLED MULTI-PURPOSE WEATHERING STEEL PLATE AND PRODUCT THEREFROM

(75) Inventors: Yulin Shen; Richard L. Bodnar, both of Bethlehem, PA (US); Jang-Yong Yoo; Wung-Yong Choo, both of Pohang-shi (KR)

(73) Assignees: Bethlehem Steel Corporation, DE (US); Pohang Iron & Steel Co., Ltd. (KR)

( * ) Notice: Under 35 U.S.C. 154(b), the term of this patent shall be extended for 0 days.

(21) Appl. No.: 09/233,508

(22) Filed: Jan. 20, 1999

(51) Int. Cl.[7] ..... C21D 8/00; C22C 38/26; C22C 38/28

(52) U.S. Cl. ..... 148/654; 148/333; 148/336; 420/104; 420/112; 420/126; 420/127; 420/128

(58) Field of Search ..... 148/654, 333, 148/336; 420/104, 126, 127, 128, 112

(56) References Cited

U.S. PATENT DOCUMENTS

| | | | | |
|---|---|---|---|---|
| 3,860,456 | * | 1/1975 | Repas | 148/12 F |
| 4,472,208 | * | 9/1984 | Kunishige | 148/12 F |
| 5,514,227 | | 5/1996 | Bodnar et al. . | |
| 5,634,988 | * | 6/1997 | Kurebayashi et al. | 148/320 |
| 5,810,951 | * | 9/1998 | Dorricott | 148/654 |
| 6,056,833 | * | 5/2000 | Asfahani et al. | 148/334 |

OTHER PUBLICATIONS

Standard Specification for Carbon and High–Strength Low–Alloy Structural Steel Shapes, Plates, and Bars and Quenched–and–Tempered Alloy Structural Steel Plates for Bridges (ASTM Designation: A709/A 709M–96).

Standard Specification for High–Strength Low–Alloy Structural Steel with 50 ksi [345 MPa] Minimum Yield Point to 4 in. [100mm] Thick (ASTM Designation: A 588/A588M–94).

Standard Specification for High–Strength Low–Alloy Structural Steel Plate With Atmospheric Corrosion Resistance (ASTM Designation: A 871/A 871M–95).

Standard Specification for Quenched and Tempered Low–Alloy Structural Steel Plate with 70 ksi [485 MPa] Minimum Yield Strength to 4 in. [100mm] Thick (ASTM Designation: A 852/A 852M–94).

Material Development for High–Performance Bridge Steels, (1995, J.M. Chilton and S.J. Manganello, Hot–Rolled Products Division, U.S. Steel Technical Center, Monroeville, PA 15146).

* cited by examiner

*Primary Examiner*—Daniel J. Jenkins
*Assistant Examiner*—Nicole Coy
(74) *Attorney, Agent, or Firm*—Harold I. Masteller, Jr; Christopher W. Brody

(57) ABSTRACT

A method of making a weathering grade steel plate includes the steps of establishing a minimum yield strength:plate thickness target from one of 50 KSI:up to 4", 65 KSI:up to 1.5", and 70 KSI:up to 1.25". A modified weathering grade alloy composition is cast into a slab employing effective levels of manganese, carbon, niobium, vanadium, nitrogen, and titanium. The cast slab is heated and rough rolled to an intermediate gauge plate. The intermediate gauge plate is controlled rolled and subjected to one of air cooling or accelerated cooling depending on the minimum yield strength and thickness target. With the controlled alloy chemistry, rolling and cooling, the final gauge plate exhibits discontinuous yielding and can be used for applications requiring a 70 KSI minimum yield strength in plate thicknesses up to 1.25", a 65 KSI minimum yield strength in plate thickness up to 1.50" and a 50 KSI minimum yield strength for plates as thick as 4".

26 Claims, 7 Drawing Sheets

METHOD OF MAKING AN AS-ROLLED MULTI-PURPOSE WEATHERING STEEL PLATE AND PRODUCT THEREFROM

FIELD OF THE INVENTION

The present invention is directed to a method of making an as-rolled multi-purpose weathering grade steel plate and a product therefrom and, in particular, to a method using a controlled alloy chemistry and controlled rolling and cooling conditions to produce an as-rolled and cooled weathering grade steel plate capable of meeting mechanical and compositional requirements for a number of ASTM specifications.

BACKGROUND ART

In the prior art, lower carbon, high strength (or High Performance Steel, HPS) weathering grade steels are being increasingly employed for bridge, pole and other high strength applications. These steel materials offer three advantages over concrete and other types of steel materials. First, the use of higher strength materials can reduce the overall weight of the structure being built and can also reduce the material cost. Consequently, designs using these weathering grade steels can be more competitive with concrete and those designs employing lower strength steels. Second, the weathering grade or atmosphere corrosion-resistant grade steel can significantly reduce the maintenance cost of structures such as bridges or poles by eliminating the need for painting. These weathering grade steels are particularly desirable in applications which are difficult to regularly maintain, for example, bridges or poles located in remote areas. Third, lower carbon (i.e., 0.1% maximum) and lower carbon equivalent levels improve the weldability and toughness of the steel.

The use of these types of steels is guided by ASTM specifications. For a medium strength application, e.g., ASTM A588-Grade B or A709-Grade 50 W, weathering steels having a 50 KSI minimum yield strength are specified. These steels typically employ about 0.16% by weight of carbon.

Other ASTM specifications for weathering steels which are commonly used for bridge and pole applications include A709-Grades 70 W and HPS 70 W for bridge applications, and A871-Grade 65 for pole or tubular applications. The bridge-building, 70 W grades require a 70 KSI minimum in yield strength. The specification requires that these grades be produced by rolling, quenching, and tempering. The conventional 70 W grade is a higher carbon grade (0.12% by weight), whereas the newer HPS 70 W grade utilizes a lower carbon level (0.10% by weight). The HPS 70 W grade is generally produced in plates up to 3"in thickness. Table 1 lists the ASTM specifications with Table 2 detailing the mechanical property requirements for the various specifications. Table 3 details the compositional requirements for these specifications. The disclosure of ASTM specification numbers A871, A852, A709 and A588 are hereby incorporated by reference. As noted above, the higher strength specifications require a hot rolled, quenched, and tempered processing. Moreover, the tensile strength is specified as a range, i.e., 90–110 KSI, rather than a minimum which is used in other specifications, see for example, A871-Grade 65 that specifies a tensile strength greater than or equal to 80 KSI.

These high strength ASTM specifications are not without their disadvantages. First, processing whereby the hot rolled, quenched and tempered product is energy intensive. Second, these quenched and tempered grades are limited by plate length due to furnace length restrictions. In other words, only certain length plates can be heat treated following the quenching operation since the furnaces will accept only a set length, in some instances, only up to 600". Bridge builders particularly are demanding ever-increasing lengths (to reduce the number of splicing welds required and save fabrication cost) of plate for construction; such demands are not being met by current plate manufacturing technology for high strength steels.

Third, the high strength ASTM specifications requiring a minimum of 70 KSI yield strength also pose a difficulty by specifying an upper limit for tensile strength, i.e., 110 KSI for A709-Grade 70 W. More particularly, one cannot merely target a minimum 70 KSI yield strength to meet the A709 specification since too high of a yield strength may also result in a tensile strength above the 110 KSI maximum.

In view of the disadvantages associated with current high strength weathering grade steel specifications, a need has developed to produce plates in ever-increasing lengths and in a more cost-effective manner (lower production cost and quicker delivery). In addition, a need has developed to provide a method for making a multi-purpose plate product that meets a number of different ASTM specifications with a single alloy chemistry and/or processing sequence. Such a development would allow longer caster strings and grade consolidation, improve production yield, and reduce slab inventory.

In response to the above-listed needs, the present invention provides a method of making a multi-purpose weathering grade steel plate and a product therefrom. More particularly, the inventive method uses a controlled alloy chemistry, a controlled rolling, and a controlled cooling to produce an as-rolled and cooled weathering grade steel plate which meets a number of ASTM specifications in terms of compositional and mechanical property requirements. The inventive method combines controlled rolling and accelerated cooling with the controlled alloy chemistry to meet the ASTM specifications for 65 KSI and 70 KSI minimum yield strengths and plate thicknesses up to 1.5" and 1.25", respectively. The processing is more energy efficient since no re-austenitizing and tempering are required.

The use of accelerated cooling and hot rolling is disclosed in U.S. Pat. No. 5,514,227 to Bodnar et al. (herein incorporated in its entirety by reference) This patent describes a method of making a steel to meet ASTM A572, Grade 50, a 50 KSI minimum yield strength specification. The alloy chemistry in this patent specifies low levels of vanadium and 1.0 to 1.25% manganese. Bodnar et al. is not directed to weathering grade steels nor methods of making plate products requiring yield strength in the range of 65 to 70 KSI.

SUMMARY OF THE INVENTION

Accordingly, it is a first object of the present invention to provide an improved method of making a weathering grade steel plate.

Another object of the present invention is a method of making a weathering grade steel plate that can be tailored to different strength requirements and plate thickness combinations.

A still further object of the present invention is a method of making a weathering grade steel plate having excellent toughness, castability, formability, and weldability.

Another object of the present invention is a multi-purpose weathering grade steel plate employing a controlled alloy chemistry and controlled rolling and cooling parameters to meet different ASTM specifications.

A further object of the invention is a method of making a weathering grade steel plate product in an as-rolled and cooled condition, making it economically superior and having a shorter delivery time compared to quenched and tempered weathering grade plates.

Yet another object is a method of making lengths of weathering grade steel plate which are not limited by heat treating furnace dimensional constraints.

Other objects and advantages of the present invention will become apparent as a description thereof proceeds.

In satisfaction of the foregoing objects and advantages, the present invention provides a method of making an as-rolled and cooled weathering grade steel plate by selecting a minimum yield strength: plate thickness target from one of 50 KSI: up to 4 inches, 65 KSI: up to 1.5 inches, and 70 KSI: up to 1.25 inches. A heated slab is provided that consists essentially of, in weight percent:

from about 0.05% to about 0.12% carbon;

from about 0.50% to about 1.35% manganese;

up to about 0.04% phosphorous;

up to about 0.05% sulfur;

from about 0.15% to about 0.65% silicon;

from about 0.20% to about 0.40% copper;

an amount of nickel up to about 0.50%;

from about 0.40% to about 0.70% chromium;

from about 0.01% to about 0.10% vanadium;

from about 0.01% to about 0.05% niobium;

from about 0.005% to about 0.02% titanium;

from about 0.001% to about 0.015% nitrogen;

an amount of aluminum up to about 0.1%;

with the balance iron and incidental impurities.

The cast slab is heated and rough rolled above the recrystallization stop temperature of austenite (i.e., $T_R$) to an intermediate gauge plate. The intermediate gauge plate is finish rolled beginning at an intermediate temperature below the $T_R$ (i.e., in the austenite non-recrystallization region) to a finish rolling temperature above the $Ar_3$ temperature to produce a final gauge plate.

The final gauge plate is either air cooled when the minimum yield strength plate thickness target is 50 KSI: up to 4 inches, and accelerated cooled in a liquid media and/or air/water mixture when the yield strength: plate thickness target is one of 65 KSI: up to 1.5 inches and 70 KSI: up to 1.25 inches. When either air or accelerated cooling, the start cooling temperature is above the $Ar_3$ temperature to ensure uniform mechanical properties throughout the entire plate length. The plates are accelerated cooled until the finish cooling temperature is below the $Ar_3$ temperature. Accelerated cooling is that cooling, using water, an air/water mixture or another quenchant, which rapidly cools the hot worked final gauge plate product to a temperature below the $Ar_3$ temperature to produce a fine grained microstructure plate product with good toughness and high strength. As will be shown below, the start and stop cooling temperatures for the accelerated cooling are important in controlling yielding behavior and meeting the various ASTM mechanical property specificafions.

The alloy chemistry has preferred embodiments to optimize the plate properties in conjunction with a given plate thickness. The manganese can range between about 0.70% and 1.00%, more preferably between about 0.70% and 0.90%. The niobium ranges between about 0.02% and 0.04%, more preferably between about 0.03% and 0.04%. The titanium ranges between about 0.01% and 0.02%, more preferably between about 0.010% and 0.015%. The vanadium ranges between about 0.06% and 0.09%, more preferably between about 0.06% and 0.08%. Nitrogen can range between about 0.006% and 0.008%.

When accelerated cooling is used, the heated slab chemistry and the accelerated cooling contribute to a discontinuous yielding effect in the cooled final gauge plate. A preferred cooling rate for the accelerated cooling step ranges between about 5 and 50° F./second for plate thicknesses ranging from 0.5 inches to up to 1.5 inches, more particularly between 10 and 50° F./second for plates of up to about 0.5 inches in thickness, 8 and 35° F./second for plates between about 0.5 inches and about 1.25 inches, and 5 and 25° F./second for plates between about 1.25 inches and 1.5 inches, and between 1° F./second and 10° F./second for plates up to 4 inches.

Preferably, during accelerated cooling, the start cooling temperature preferably ranges from about 1350° F. to about 1600° F., more preferably from about 1400° F. to about 1550° F. The finish cooling temperature ranges between about 900° F. and 1300° F., more preferably, between about 1000° F. and 1150° F.

The invention also includes a plate made by the inventive method as an as-rolled and cooled weathering grade steel plate, not a quenched and tempered plate product. The plate can have one of: (1) a plate thickness of at least 1.25 inches and a minimum of 70 KSI yield strength; (2) a plate thickness of at least 1.50 inches and a minimum of 65 KSI yield strength; and (3) a plate thickness of up to 4.0 inches and a minimum of 50 KSI yield strength. The alloy chemistry or composition is also part of the invention, in terms of its broad and preferred ranges.

BRIEF DESCRIPTION OF THE DRAWINGS

Reference is now made to the drawings of the invention wherein.

DESCRIPTION OF THE PREFERRED EMBODIMENTS

Figure 1A:
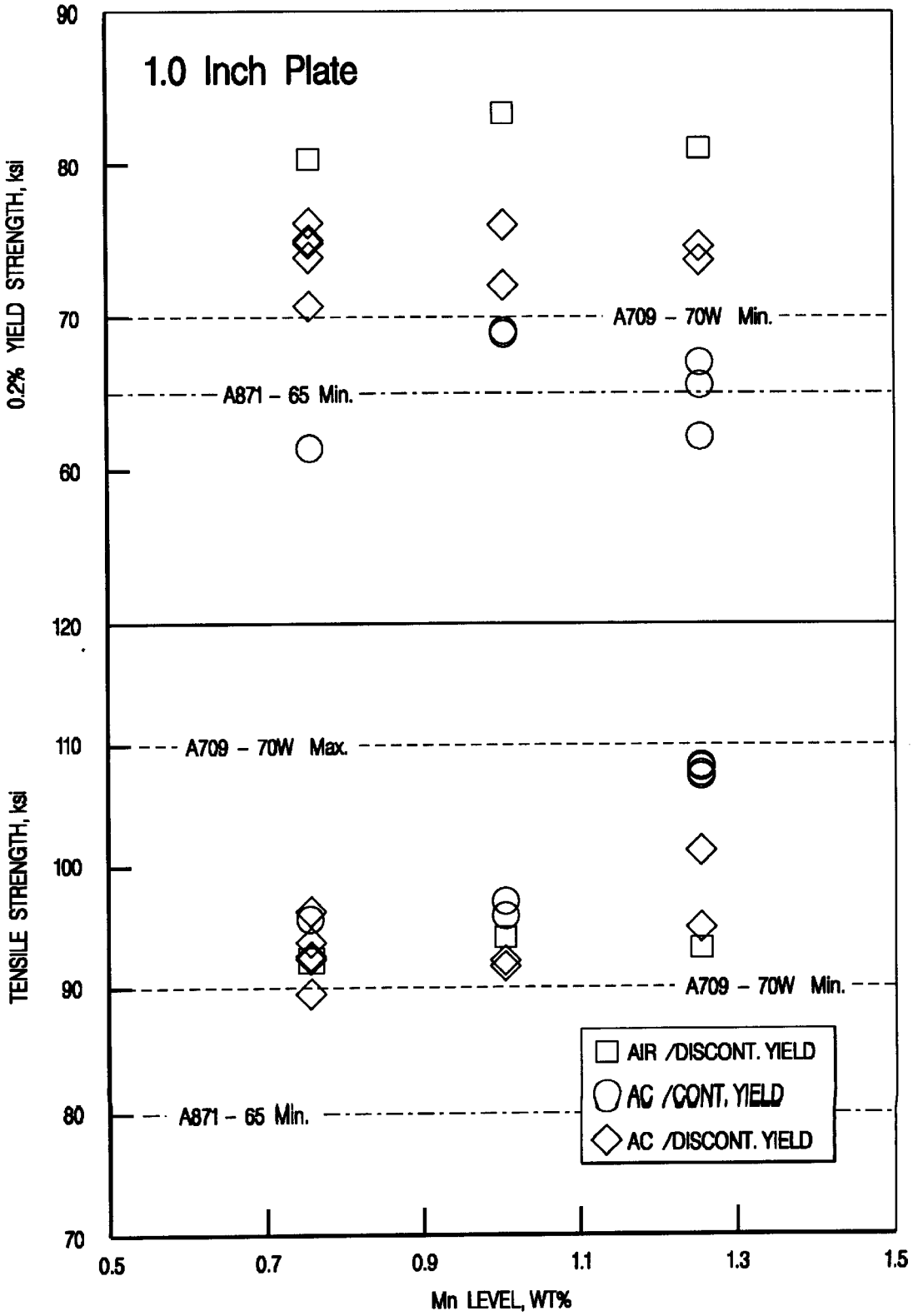
FIG. 1A is a graph based on laboratory-derived data that depicts the effects of manganese and yielding phenomena on yield strength and tensile strength for 1.0" plates.

The present invention provides a significant advancement in producing weathering grade steel plate in terms of costeffectiveness, improved mill productivity, flexibility, improved formability, castability, and weldability, and energy efficiency. The inventive method produces a weathering grade steel plate in an as-rolled and cooled condition, thereby eliminating the need for quenching and tempering (i.e., saving production cost and shortening delivery time) as is used in present day weathering grade steel plates. With the inventive processing, the chemical and mechanical requirements for a variety of ASTM specifications can be met so that the invention produces a multi-purpose weathering steel plate. Weathering grade is intended to mean alloy chemistries as exemplified by the above-referenced ASTM specifications that employ effective levels of copper, nickel, chromium and silicon to achieve atmospheric corrosion resistance whereby the steel can be used bare (i.e., without painting) in some applications.

In addition, the length of the as-produced plate is not limited to lengths required to fit existing austenitizing and tempering furnaces. Thus, lengths in excess of 600" or more can be made to meet specific applications, e.g., bridge building and utility pole use. Thus, longer plates can be used in bridge building fabrication, thereby reducing the number of splicing welds.

The inventive method links the selection of a minimum yield strength: plate thickness target to a sequence of first casting a shape, e.g., a slab or ingot, having a controlled alloy chemistry and subsequent controlled rolling into a plate. It is preferred to continuously cast slabs to fully achieve the benefits of titanium nitride technology. That is, continuous casting produces a fine dispersion of titanium nitride particles that restrict grain growth during reheating and after each austentite recrystallization. Following controlled rolling, the final gauge rolled plate product is subjected to cooling, either air cooling or accelerated cooling, depending on the minimum yield strength and plate thickness target.

The plate thickness can range up to 4" in thickness for a minimum 50 KSI yield strength, up to 1.5" in thickness for a minimum 65 KSI yield strength and up to 1.25" for a minimum 70 KSI yield strength.

The alloy chemistry includes the alloying elements of carbon, manganese, and effective amounts of silicon, copper, nickel, and chromium. These latter four elements contribute to the weathering or atmospheric corrosion resistant properties of the as-rolled and cooled plate. With these elements, the as-rolled and cooled plate has a minimum Corrosion Index of at least 6.0, preferably at least 6.7, per ASTM G101, the Guide for Estimating the Atmospheric Corrosion Resistance of Low-Alloy Steels.

Microalloying elements of titanium, niobium, and vanadium are also used along with an effective amount of nitrogen. The balance of the alloying chemistry is iron, other basic steelmaking elements such as sulfur, phosphorous, aluminum and those other incidental impurities commonly found in these types of steels.

The carbon is controlled to a low level, that which is below the peritectic cracking sensitive region to improve castability, weldability, and formability. The presence of titanium introduces fine titanium nitride particles to restrict austenitic grain growth during reheating and after each rough rolling pass or austenitic recrystallization step. The presence of niobium carbonitrides retards austenite recrystallization during rolling and provides precipitation strengthening in the as-cooled microstructure. The vanadium addition provides precipitation hardening of the transformed microstructure.

It should also be understood that the alloy chemistry is tailored to contribute to the presence of a discontinuous yielding in the as-rolled and cooled plate. Discontinuous yielding is marked by the presence of a yield drop in an engineering stress-strain diagram. More particularly, in these types of materials, elastic deformation occurs rapidly until a definitive yield point is reached. At the yield point, a discontinuity occurs whereby stress does not continuously increase with respect to applied strain. Beyond the yield point, a continued increase in stress/strain causes further plastic deformation. Continuous yielding, on the other hand, is marked by the absence of a distinct yield point, thus showing a continuous transition from elastic to plastic deformation. Depending on steel chemistry and microstructure, the onset of plastic deformation can be earlier (lower yield strength) or similar to that of the similar steel which exhibits discontinuous yielding.

Yield strength is often measured at a 0.2% offset to account for the discontinuous yielding phenomena or the yield point in many materials. However, using a 0.2% offset to measure yield strength can result in a somewhat lower yield strength for materials that exhibit continuous yielding behavior (when the onset of plastic deformation occurs at a low strength). Consequently, materials that exhibit continuous yielding may not meet the minimum yield strengths for the ASTM specifications noted above.

The inventive method is tailored in both alloy chemistry and controlled rolling/cooling to produce a discontinuous yielding plate to assure that the minimum yield strengths and required tensile strengths in the various ASTM specifications are met in the final gauge plate.

Once the target plate yield strength and thickness is established, the alloy is cast into an ingot or a slab for subsequent hot deformation. Since such casting techniques are well known in the art, a further description thereof is not deemed necessary for understanding of the invention. After casting, the cast slab is reheated between about 2000° F. and 2400° F., preferably around 2300° F., and subjected to a controlled hot rolling. A first step in the hot rolling process is a rough rolling of the slab above the recrystallization stop temperature (generally being around 1800° F.). This temperature is recognized in the art and a further description is not deemed necessary for understanding of the invention. During this rough rolling, the coarse grains of the as-cast slab are refined by austenite recrystallization for each rolling pass. The level of reduction can vary depending on the final gauge plate target and the thickness of the as-cast slab. For example, when casting a 10" slab, the slab may be rough rolled to a thickness ranging from 1.5" to 7" during the rough rolling step.

This intermediate or transfer gauge plate is then controlled finished rolled as described below. The intermediate gauge plate is finished rolled at a temperature below the recrystallization stop temperature but above the austenite transformation start temperature ($Ar_3$) to reach the final gauge. The level of reduction in this rolling sequence may also vary but ranges from about 50 to 70% reduction, preferably 60–70%, from the intermediate gauge to the final gauge plate. During this finish rolling step, the grains are flattened to enhance grain refinement in the finally cooled product.

Once the finish rolling step is completed, the final gauge plate can be subjected to cooling, either air-cooling or accelerated cooling, depending on the minimum yield strength and plate thickness target. As will be demonstrated in more detail below, a target of a minimum of 50 KSI yield strength with a plate thickness of up to 3 to 4" can be met by merely air cooling the final gauge plate product (accelerated cooling can be employed if extra strength is needed to assure strength consistency, i.e., >50 KSI, in heavy gauge plates, e.g., 4" thick). Alternatively, accelerated cooling (AC) can be used to achieve either a 65 KSI or 70 KSI minimum yield strength. Plates as thick as 1.25" can be made meeting the 70 KSI minimum yield strength with accelerated cooling. Plates as thick as 1.5" can be made that meet the 65 KSI minimum yield strength. In other words, using the controlled chemistry, the controlled rolling and either air cooling or accelerated cooling, a multi-purpose weathering grade steel plate can be produced to meet various ASTM specifications.

The controlled finish rolling is performed under moderate conditions. That is, the finish rolling temperature is targeted at above the $Ar_3$ temperature to achieve both a very fine grain structure in the final gauge plate product and improved mill productivity. By finishing the rolling at a temperature significantly higher than the $Ar_3$ temperature, the rolling requires a shorter total time, thereby increasing mill productivity. The finish rolling temperature can range from about 1400° F. to 1650° F. Rolling above the $Ar_3$ temperature also provides a non-uniform structure in the final gauge plate.

The accelerated cooling step contributes to the discontinuous yielding characteristic of the final gauge plate. More particularly, if the accelerated cooling is done improperly, the final gauge plate product may contain a large amount of martensite which causes continuous yielding behavior and can result in a low yield strength. Consequently, it is desirable that the finish cooling temperature of the accelerated cooling step be sufficiently high to minimize the formation of a significant amount of martensite in the final gauge plate. A preferred range for the finish cooling temperature is between about 850° F. and 1280° F.

As mentioned above, rolling is completed above the $Ar_3$ temperature and the start of cooling should commence above this limit as well. A preferred range for the start cooling temperature is between about 1350° F. and 1550° F. (depending on the actual $Ar_3$ temperature of each steel chemistry).

The broad and more preferred weight percentage ranges and limits for the various alloying elements are defined in weight percent as follows:

carbon 0.05–0.12%, preferably 0.07–0.10%, more preferably 0.075–085% with an aim of 0.08%;

manganese 0.5–1.35%, preferably 0.60–1.25%, more preferably 0.70–0.90%, most preferably 0.75–0.85%, with an aim of 0.80%;

up to about 0.04% phosphorous;

up to about 0.05% sulfur;

from about 0.15% to about 0.65% silicon;

from about 0.20% to about 0.40% copper;

from about 0.40% to about 0.70% chromium;

an amount of nickel up to about 0.50%, preferably between about 0.20% and 0.40%;

vanadium, 0.01–0.10%, preferably 0.03–0.10%, more preferably 0.06–0.09%, with an aim of 0.07% or 0.08%;

niobium 0.01–0.05%, preferably 0.02–0.04%, more preferably 0.03–0.04%, with an aim of 0.035%;

titanium 0.005–0.02%, preferably 0.01–0.02%, more preferably 0.01%–0.015%, with an aim of 0.012%;

an amount of nitrogen up to 0.015%; preferably 0.001–0.015%, more preferably 0.006–0.008%, an amount of aluminum up to 0.1%, generally in an amount to fully kill the steel during processing, preferably between about 0.02% and 0.06%; and the balance iron and incidental impurities.

A preferred target chemistry is about 0.07–0.09% C, 0.75–0.85% Mn, 0.3–0.5% Si, 0.2–0.4% Cu, 0.2–0.4% Ni, 0.4–0.6% Cr, 0.03–0.04% Nb, 0.06–0.08% V, 0.01–0.015% Ti, 0.006–0.008% N, with the balance iron and incidental impurities, with aims of 0.08% C, 0.80% Mn, 0.4% Si, 0.3% Cu, 0.3% Ni, 0.5% Cr, 0.035% Nb, 0.07% V, 0.012% Ti, 0.007% N, with the balance iron and incidental impurities.

Elements in levels that produce a continuous yielding behavior in the plate products are not desirable or intended to be a part of the alloy chemistry, e.g., molybdenum in levels exceeding 0.025%, boron and the like. While molybdenum or boron may be present in amounts in the steel slabs as a result of the raw materials used in the basic steelmaking process, the presence of the elements are considered to be impurity levels and do not function as a physical property-altering alloying elements to the plate, particularly molybdenum in amounts of about 0.025% and less, more particularly 0.015% or less.

The steel may be either in a fully killed state or semi-killed state when processed, but is preferably fully killed for castability and enhanced toughness. Since "killing" of steel along with the addition of conventional killing elements, e.g., aluminum, are well recognized in the art, no further description is deemed necessary for this aspect of the invention.

Experimental trials were conducted both on a laboratory scale and a mill scale investigating the various aspects of the invention. The following details the procedures and results associated with both the laboratory and mill trials. It should be understood that the actual trials conducted are intended to be exemplary in terms of the various processing and compositional parameters used in conjunction with the invention. Such trials are not to be interpreted as limiting the scope of the invention as defined by the appended claims. Percentages unless otherwise stated are in weight percent. Metric conversion for the experimental values can be made using the factors: 1 KSI=6.92 MPa, 1 KSI=1.43 kg/mm$^2$, ° C.=5/9(° F−32),and 1"=2.54 cm.

LABORATORY TRIALS PROCEDURES

Three experimental compositions with different manganese levels (0.75% Mn, 1.00% Mn, and 1.25% Mn) were melted in a vacuum-induction furnace and cast as 500-lb. ingots measuring about 8.5" square by 20" long. Two ingots of the 0.75% Mn grade, two ingots of the 1.25% Mn grade, and one ingot of the 1.00% Mn grade were produced. The product analyses for each heat are listed in Table 4. Each of the ingots was first soaked at 2300° F. for three hours, and hot rolled to either 4" thick by 5" wide billets, or 6" thick by 5" wide billets. Small, 4" to 5" long mults were cut from each billet, reheated to 2300° F. and control rolled to 0.5", 1" and 1.5" thick plates. The range of rolling and cooling parameters investigated for all the plates produced by AC processing are shown in Table 5.

A laboratory apparatus was used to simulate production accelerated cooled processing. The apparatus includes a pneumatic-driven quenching rack and a cooling tank filled with 1 to 4% (by volume) Aqua Quench 110, a polymer quenchant, and water. After the last pass of finish rolling, the plate is moved onto the rack, and quenched on a cooling table inside the tank. The plate mid-thickness temperature is continuously monitored by an embedded thermocouple, and when the temperature reaches the desired finish cooling temperature (FCT), the plate is removed from the solution and cooled in air. In some cases, multiple plates were produced in order to confirm the results.

For evaluation of mechanical properties, duplicate, transverse tensile specimens were machined from the 0.5" plates (full thickness, flat threaded specimens), and 1" and 1.5" plates (¼ t, 0.505" diameter specimens). Three longitudinal, full-size Charpy V-notch (CVN) specimens were removed from each plate, at the ½ t location for the 0.5" plates, and at the ¼ t location for the 1" and 1.5" plates. The testing temperatures were either −10° F. or −20° F. For metallographic examination, small full-thickness specimens were removed from each plate and polished on a longitudinal face, etched in 4% picral and 2% nital solutions, and examined in a light microscope. In addition to the accelerated cooled simulation studies, a 2" thick 0.75% Mn plate was produced using controlled finish temperature (CFT) rolling and air cooling to determine if this composition can meet the A588/A709-50W requirements.

LABORATORY TRIALS RESULTS

Table 4 shows the actual compositions of five Alloys A–E as used to investigate the effects of varying levels of manganese, i.e., 0.75%, 1.00%, and 1.25%. In addition, Table 4 shows that Alloys A–E differ significantly from the ASTM specification compositions shown in Table 3. More particularly, the controlled alloy chemistry of the invention utilizes generally lower manganese, effective amounts of niobium and titanium, and impurity levels of molybdenum. The Table 4 weathering elements of silicon, copper, nickel, and chromium are maintained within the limits for these elements as shown in Table 3.

The microstructure of the plate produced from the Table 4 compositions and controlled rolling and accelerated cooling varied with increasing manganese. The 0.75% Mn Alloys A and B contain primarily polygonal ferrite and pearlite, with small amounts of bainite and martensite present. Alloy C, 1.00% Mn, also consisted largely of polygonal ferrite, but the second phase is mainly bainite and martensite with some pearlite. Alloys D and E, the 1.25% Mn steel, had less polygonal ferrite, much more bainite and martensite, and very little pearlite. For the 0.5" thick plates, the rolling practice was deemed moderate, i.e., a target intermediate temperature of 1750° F., a finish rolling temperature of 1600° F. and a 60% reduction between the intermediate temperature and the finish rolling temperature. This moderate rolling practice contrasts with the more severe practice used for the conventionally controlled rolled and air-cooled plate, i.e., an intermediate temperature of 1650° F., a finish rolling temperature of 1350° F. and a 60% reduction between the intermediate temperature and the finish rolling temperature. The accelerated cooling practice for the 0.5" thick plates was normally 1500° F. for a start cooling temperature, 1100° F. for a finish cooling temperature and 25° F./second as a cooling rate.

Similar moderate rolling and accelerated cooling conditions were used for the 1" and 1.5" plates. The 1" plates used an 1800° F./1600° F./70% moderate rolling practice (intermediate temperature (IT)/finishing rolling temperature (FRT)/% reduction between IT and FRT). The accelerated cooling was targeted at 1550° F./1100° F./second, (start cooling temperature (SCT)/ finish cooling temperature (FCT)/cooling rate (CR)). The microstructure of the 1" plates was similar to that of the 0.5" plates for the 0.75% Mn and 10% Mn steels. However, alloys D and E, the 1.25% Mn steel, had far less polygonal ferrite, much more bainite and martensite, and little, if any, pearlite.

The controlled rolling and cooling sequences for the 1.5" plates were 1700° F./1550° F./60%,(rolling) and 1470° F./1150° F./10° F./second (accelerated cooling), respectively. Generally, the microstructure became more coarse as the plate thickness increased.

Each of alloys A–E were also subjected to controlled rolling and air-cooling for comparative purposes.

Figure 1B:
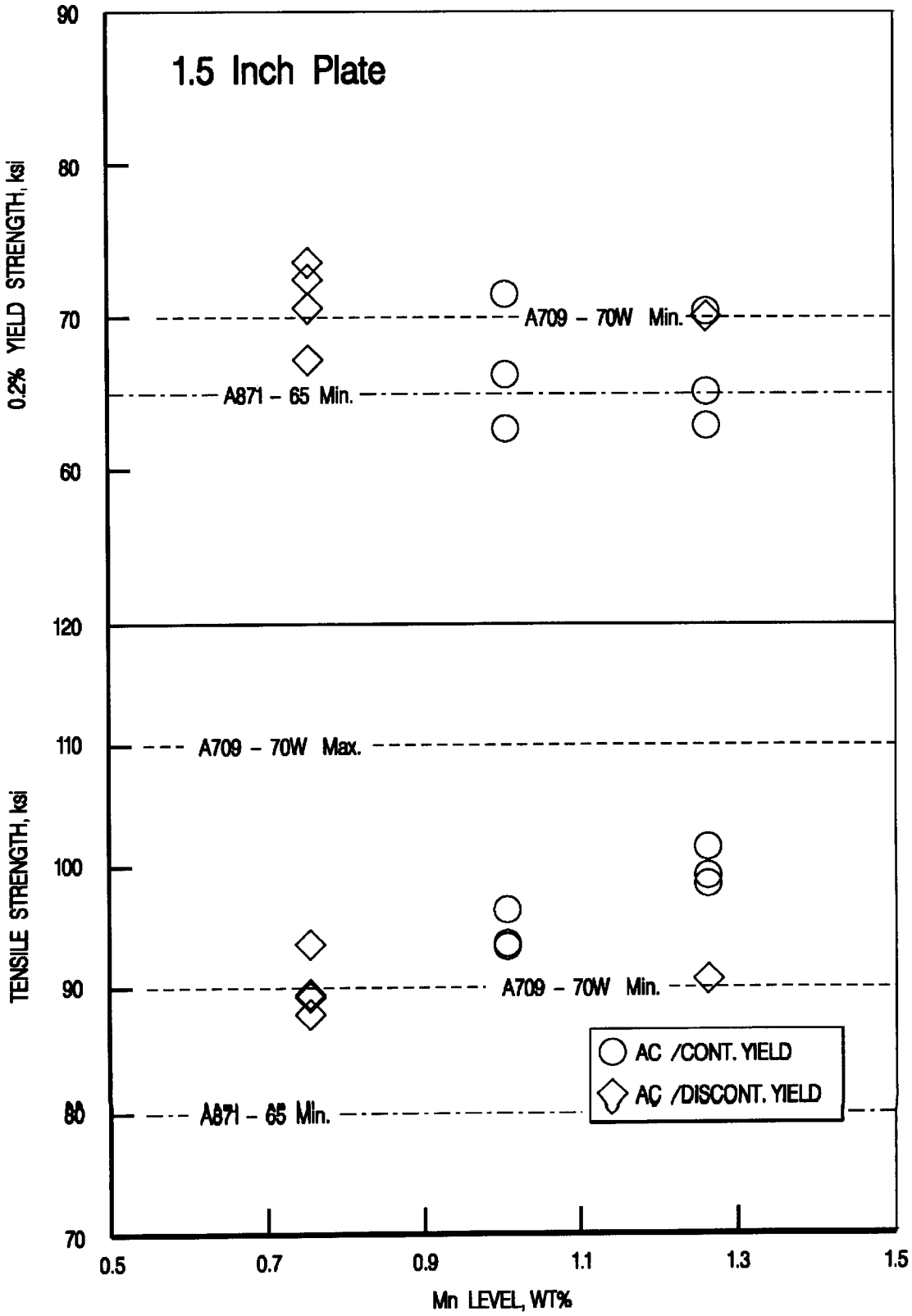
FIG. 1B is a graph based on laboratory-derived data that depicts the effects of manganese and yielding phenomena on yield strength and tensile strength for 1.5" plates.

The mechanical properties of the various alloys A–E were analyzed in terms of the varying levels of manganese, air and accelerated cooling and discontinuous and continuous yielding. FIGS. 1A and 1B depict graphs comparing tensile strength and yield strength with varying manganese levels for air-cooled and accelerated cooled plates. FIG. 1A presents data derived using 1.0" plates with FIG. 1B depicting data derived for 1.5" plates.

First, FIGS. 1A and 1B show that increasing levels of manganese result in increasing levels of tensile strength. Second, these Figures show that for all alloys subjected to air-cooling, discontinuous yielding occurred. In contrast, certain accelerated cooled alloys exhibited discontinuous yielding, such represented by the diamonds, and other alloys exhibited continuous yielding, these plates represented by the circles.

Referring to FIG. 1B, the accelerated cooled and discontinuous yielding materials having 0.75% manganese failed to meet the 90 KSI tensile strength minimum of the ASTM designation A709-70W.

FIGS. 1A and 1B also indicate that manganese has a significant effect on the yielding behavior. That is, the higher the manganese level, the higher the hardenability of the steel and the higher the volume fraction of martensite and bainite in the as-cooled plates. The presence of a high density of mobile dislocations in these un-tempered martensite and bainite structures alters the work hardening behavior, as compared to the ferrite/pearlite microstructure, and results in continuous yielding in the early stage and high tensile strength toward the end of the testing. When continuous yielding occurs (plastic deformation takes place fairly quickly), a significantly lower yield strength may result when using a measurement at a 0.2% offset. As is evident from FIG. 1A, the 0.75% manganese level alloy has a lesser tendency for continuous yielding whereas the 1.25% manganese steel is prone to continuous yielding. Consequently, the yield strength of several of the 0.75% manganese plates generally meet the 70 KSI minimum yield strength requirement, while most of the 1.25% manganese plates do not meet such a minimum, and in some cases, not even a minimum yield strength of 65 KSI.

Figure 2A:
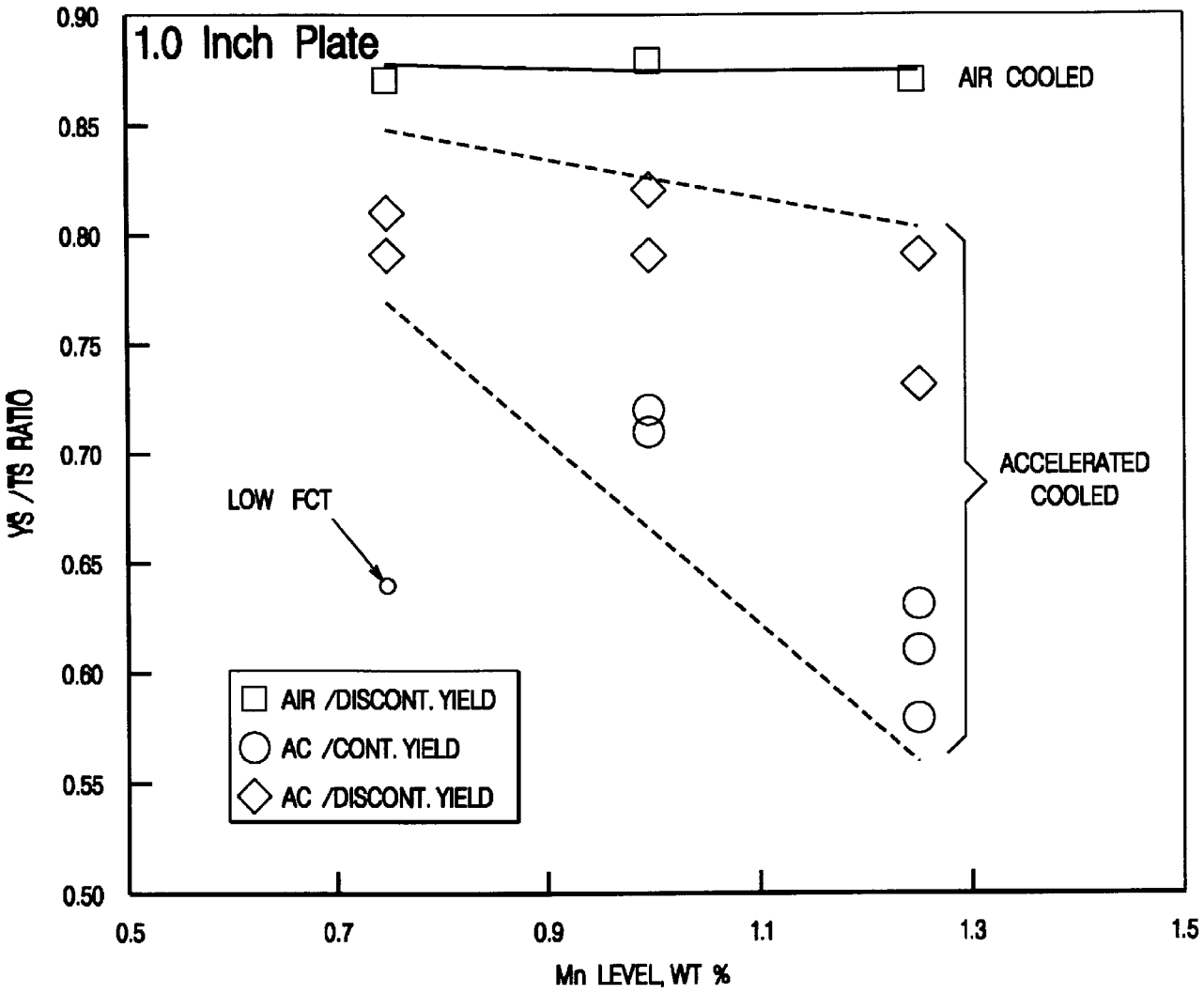
FIG. 2A is a graph based on laboratory-derived data showing YS/TS ratios for varying manganese levels and air cooled and accelerated cooled 1.0" plates.

When examining the ratio of yield strength to tensile strength, the specimens exhibiting continuous yielding behavior generally have a low yield strength and high tensile strength, thus a low YS/TS ratio. In contrast, the air-cooled plates show the highest YS/TS ratio (i.e., >0.85), with the discontinuous yielding accelerated cooled plates having a YS/TS ratio (i.e., 0.73 to 0.82) between the continuous yielding accelerated cooled plates and the air-cooled plates. FIG. 2A illustrates YS/TS ratios for different processed 1.0" plates. FIG. 2A also confirms the effect of increased manganese levels on continuous yielding, i.e., more manganese results in a lower YS/TS ratio.

The Charpy impact energies were tested for the various alloys. The results of this testing showed that all of the compositions and rolling and cooling practices met the ASTM designation A709-70W (American Association of State Highway and Transportation Officials—AASHTO) fracture critical Zone 3 requirement of a minimum of 35 ft-lbs at −10° F.

Referring again to FIG. 1B, it should be noted that for the 1.5" plates, the accelerated cooled and discontinuous yielding plates did not meet the minimum 70 KSI yield strength or 90 KSI tensile strength. However, this Figure does show that, for these thickness plates, the 65 KSI minimum yield strength is met. In other words, the inventive processing can be used to make 1.5" plates that meet the 65 KSI yield strength minimum of the ASTM A871 specification and, as demonstrated below, up to 1.25" plates for the 70 KSI minimum specification.

When investigating the effect of finishing rolling temperature, it was determined that the more important factors which determine yielding behavior and resulting final strength are the cooling parameters, namely, finish cooling temperature and cooling rate. No particular trend was noticed relating strength levels and finish rolling temperatures. It should be noted that a minimum of 60% total reduction below the intermediate temperature is preferred to insure adequate hot working below the recrystallization stop temperature (estimated to be about 1800° F.) to insure proper grain refinement.

Figure 2B:
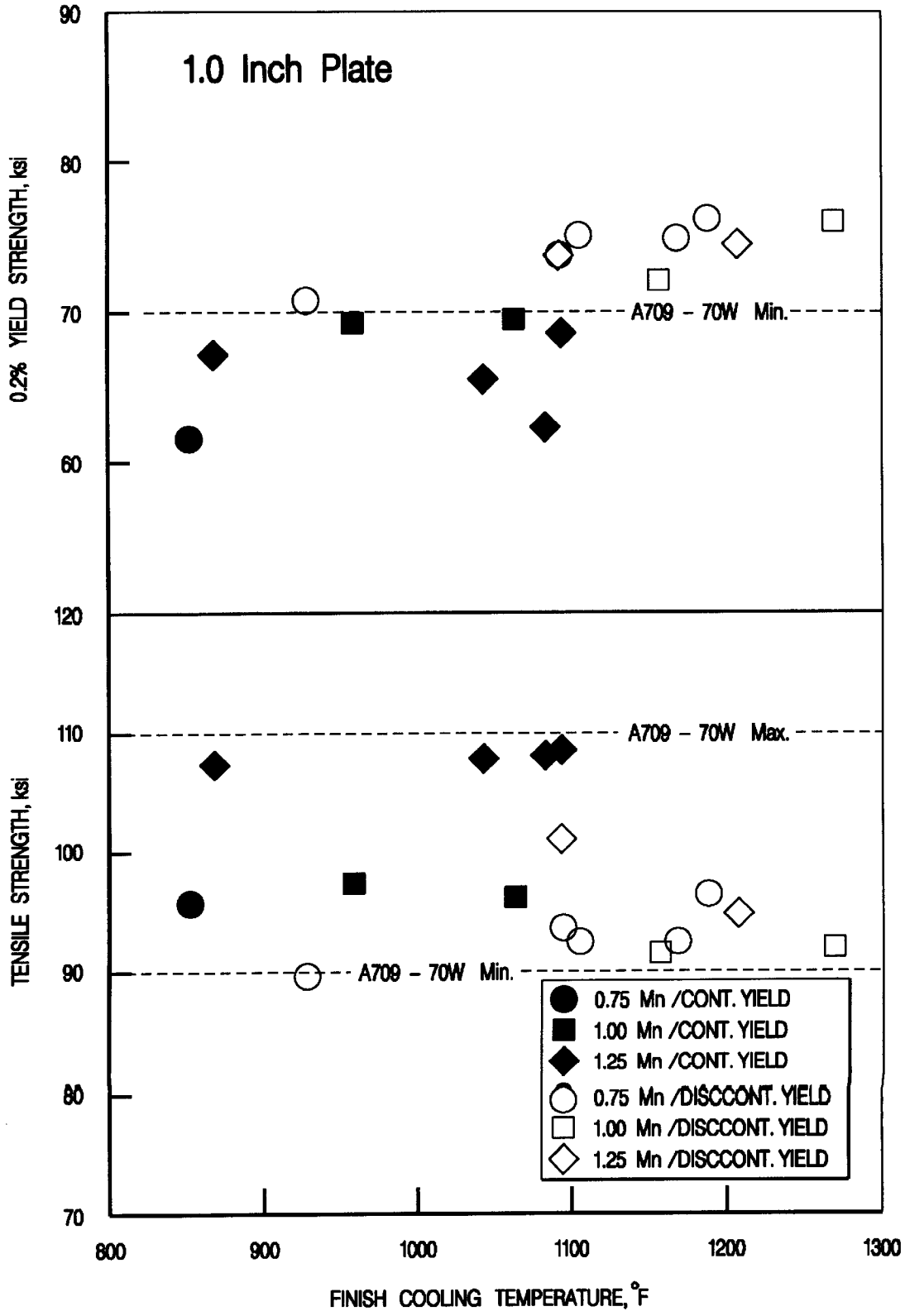
FIG. 2B is a graph based on laboratory-derived data that depicts the effects of finish cooling temperature and yielding phenomena on yield strength and tensile strength for 1.0" plates.

FIG. 2B exemplifies the effect on finish cooling temperature by yield strength and tensile strength for 1" accelerated cooled plates. This Figure shows that utilizing a finish cooling temperature that is too low can result in a large amount of martensite, thus causing continuous yielding behavior and a low yield strength. While the finish cooling temperature is not as critical for plates on the order of 0.5" thick, it does become more important for thicker plates. One reason that the finish cooling temperature may be too low during production is the occurrence of re-wetting during cooling. Re-wetting is the onset of the nucleate boiling regime during quenching, this regime is more violent than stable-film boiling. Re-wetting makes it difficult to control the heat flux and the plate can be easily over-cooled, resulting in surface roughness, distortion and property non-uniformity. During accelerating cooling, a thick surface scale, a high cooling flux, and low finishing cooling temperature can promote re-wetting. Re-wetting can be minimized using good descaling practices during rolling and an optimum cooling strategy. However, for heavy gauge plates, for example, greater than 1.5", it is difficult to totally eliminate re-wetting and care must be taken when accelerated cooling these types of plates.

The 0.75% Mn 2" plate when control rolled to a specific temperature and air cooled showed a ferrite and pearlite microstructure. The plate exhibited a yield strength of 59 KSI and a tensile strength of 75 KSI, thus showing that the air cooled 2" plate meets the A588 Grade 50 W specification requirements for 2" plate. Charpy impact testing also revealed compliance with the 30 ft-lbs minimum at +10° F. for this grade. With these results, it is likely that plates of up to 4" in thickness made using the inventive processing (controlled finish temperature rolling and air cooling) would also meet the A588 Grade 50 W specification. When necessary, a moderate accelerated cooling processing can be added to ensure adequate strength for heavy gauge A588 plates.

The laboratory trials clearly demonstrate that controlling the alloy chemistry as specified above and the rolling/cooling, either air-cooling or accelerated cooling, results in a multi-purpose plate, capable of meeting several ASTM specifications for a given thickness plate.

MILL TRIALS PROCEDURES

A 300 ton BOF (basic oxygen furnace) heat of the laboratory-development grade of the invention, ALLOY X, was made and continuously cast into 10" thick slabs. In the same trial, slabs of an alloy meeting the current A709 HPS 70W, Q & T specification, ALLOY Y (i.e., prior art material), were also rolled and accelerated cooled to determine if this grade could also be produced by accelerated cooled processing to achieve the required mechanical properties for A709-70W. The chemical analyses of both heats are shown in Table 6. The carbon content and all the weathering elements (i.e., Si, Cu, Ni, Cr) are about the same in Alloy Y and Alloy X. However, the manganese level in Alloy Y is higher than Alloy X(1.2% vs. 0.8%). Also, Alloy Y is designed for quenching and tempering, and contains no titanium (i.e., for grain refinement using TiN technology) and no niobium (i.e., for grain refinement, austenite recrystallization control, and precipitation strengthening). Four nominal thicknesses were evaluated in the trial: 0.75", 1.0", 1.25", and 1.5". These rolling and cooling parameters are generally based on the laboratory simulation studies. As mentioned previously, in the laboratory accelerated cooled simulations, the temperature control was based on actual measurements at the mid-thickness location. In contrast, a surface temperature was used for control in accelerated cooled mill production. Since the presence of surface scale and a temperature gradient through the thickness can cause a temperature difference between the laboratory mid-thickness location and the mill surface, the target temperatures used in the mill trials were slightly higher than those of the laboratory testing. After accelerated cooling and hot leveling, the plates were allowed to cool in air to ambient.

In most cases, the mid-width, front (head location) and back (tail location) of the plates were tested for transverse tensile and longitudinal CVN properties. Selected plates were cut in half and tested for mid-length properties.

MILL TRIALS RESULTS

The mill trial results generally confirm the laboratory results in terms of the as-rolled and cooled plate meeting the 70 KSI minimum yield strength at plate thicknesses up to 1.25", and also meeting the 65 KSI minimum yield strength for plates up to 1.5". Likewise, the mill trials confirmed the differences in microstructure based on varying manganese content and plate thickness.

The mill trials also demonstrated that the prior art alloy chemistry specified for the ASTM designation A709 HPS 70W cannot be merely rolled and accelerated cooled and still meet the mechanical property requirements of this specification.

Figure 3:
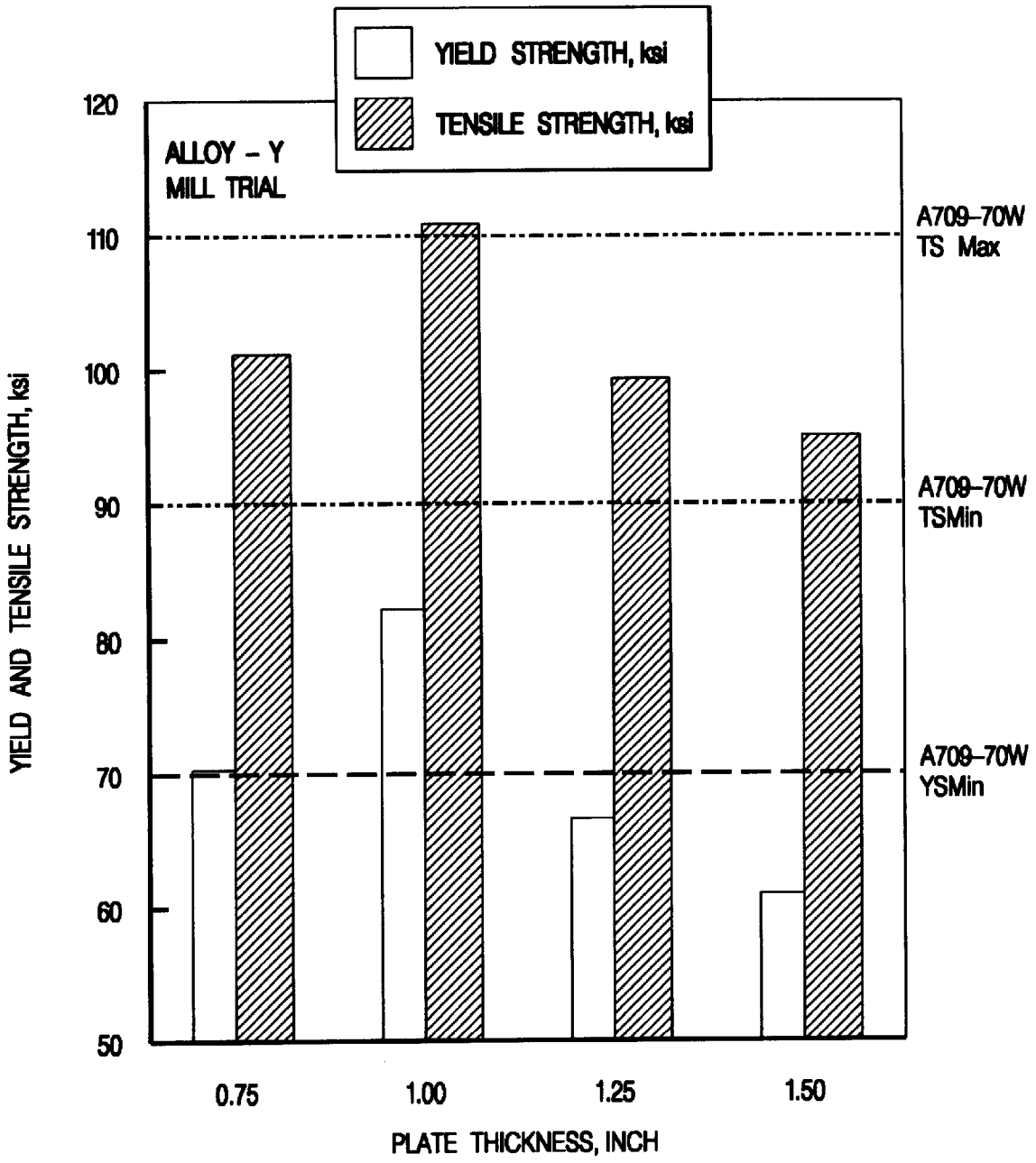
FIG. 3 is a bar graph based on mill-derived data that compares plate thickness, yield strength and tensile strength for an as-rolled and cooled prior art alloy.
Figure 4:
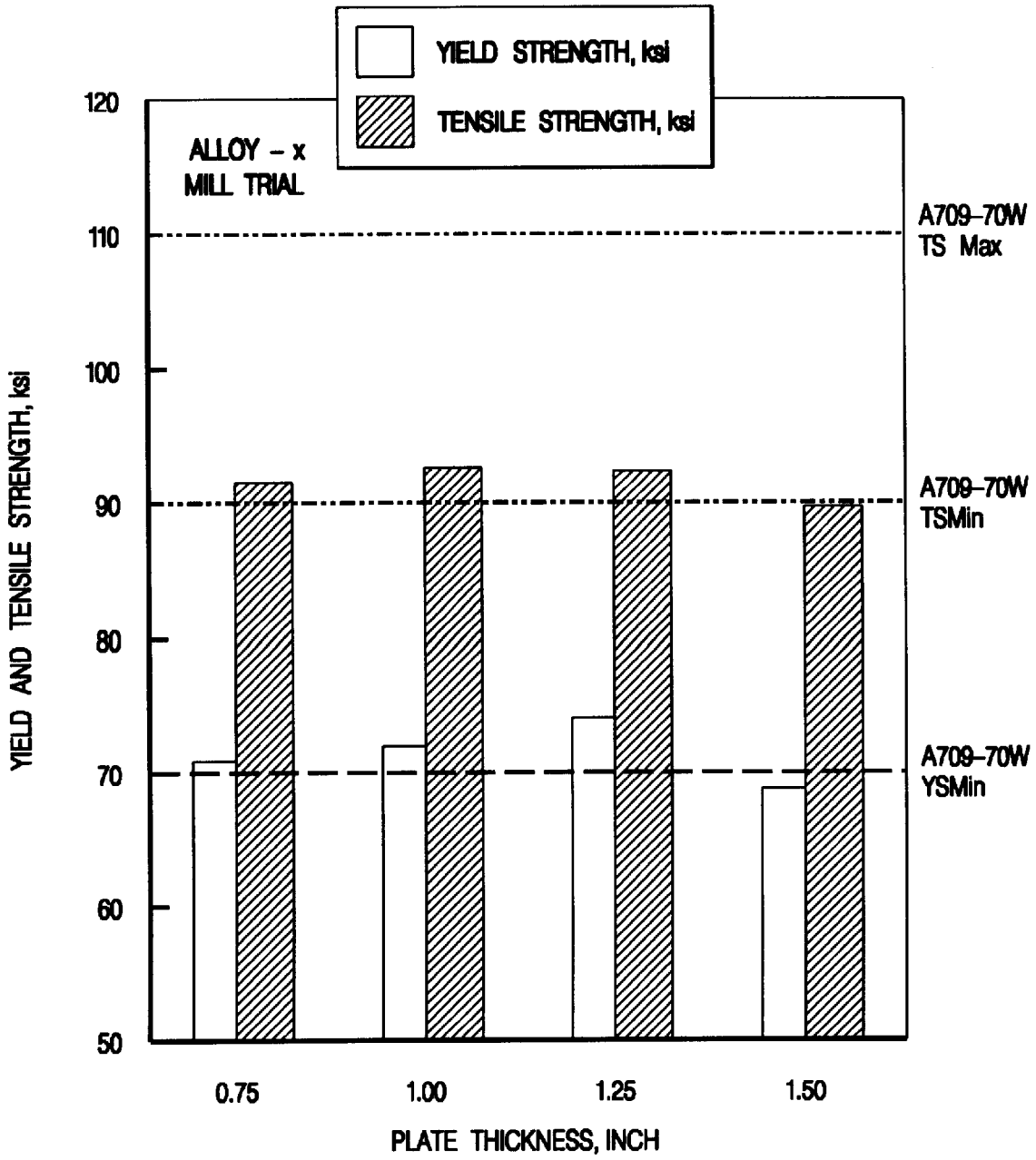
FIG. 4 is a bar graph based on mill-derived data that compares plate thickness, yield strength and tensile strength using the inventive processing and chemistry.

Referring now to FIGS. 3 and 4, Alloys Y and X, as exemplified in Table 6, are compared in terms of yield and tensile strength and plate thickness. FIG. 3 shows that the as-rolled and cooled HPS 70W specification alloy chemistry (Alloy Y) does not consistently meet the 70 KSI minimum yield strength for plate thicknesses of 0.75", 1.25", and 1.5". In contrast, FIG. 4 demonstrates that the 70 KSI minimum yield strength can be met for (Alloy X) plate thicknesses up to 1.25". Again, the 1.5" plate, while not meeting the 70 KSI minimum yield strength, is still acceptable for the specification requiring a 65 KSI minimum yield strength.

Alloy Y of FIG. 3 exhibited continuous yielding behavior as a result of its higher hardenability and resulting large amount of martensite in the as-cooled plates. Due to the large amount of martensite, the impact toughness of the Alloy Y is less than Alloy X.

ADDITIONAL LABORATORY STUDIES AND RESULTS

Figure 5:
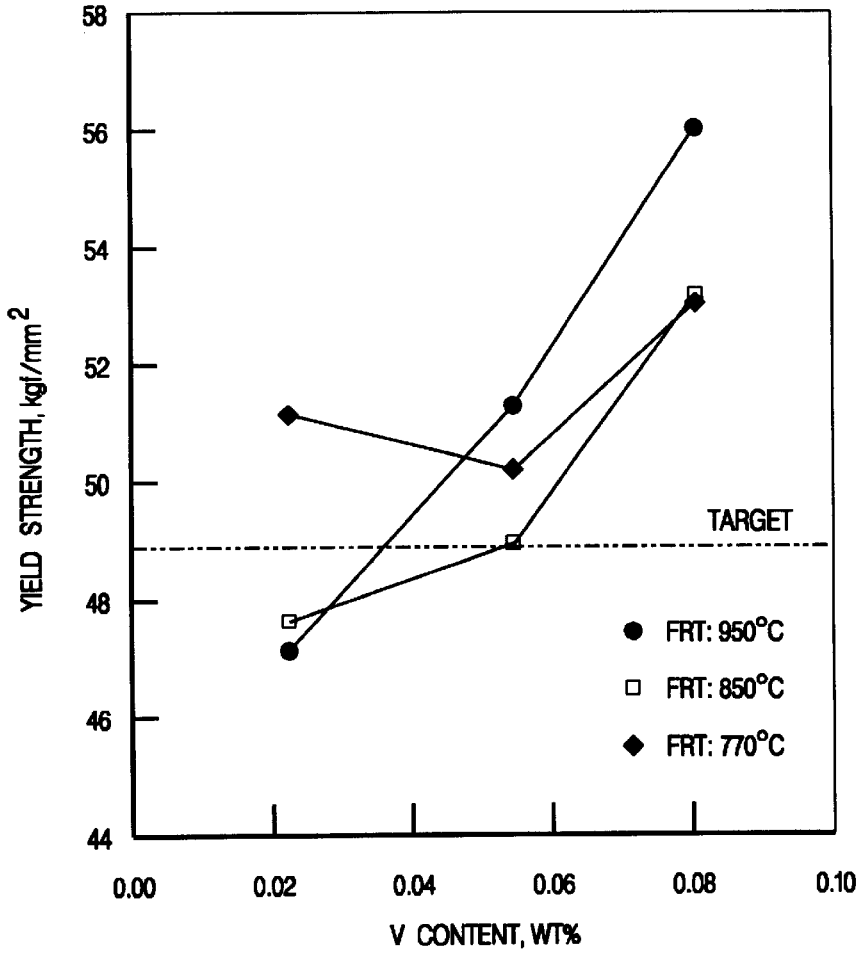
FIG. 5 is a graph based on laboratory-derived data that depicts the effect of vanadium content and finish rolling temperature on yield strength.

Additional laboratory/mill studies were conducted on 0.5" thick accelerated cooled plates to investigate the effect of vanadium and niobium. A base composition having aims of 0.08% carbon, 0.8% manganese, 0.40% silicon, 0.35% copper, 0.20% nickel, 0.49% chromium, 0.035% niobium, and 0.011% titanium was used with three levels of vanadium, i.e., 0.02%, 0.054%, and 0.079%. FIG. 5 shows the effect of yield strength for varying vanadium contents for three different rolling temperatures. As is evident from this FIG., to meet the 70 KSI minimum yield strength, 49 kg/mm$^2$, the vanadium content should be higher than about 0.054%, with an aim of about 0.07%. This graph also shows that a higher finish rolling temperature is preferred to maintain an adequate yield strength. During this trial, the start cooling temperature ranged between 1390° F. and 1680° F., the finish cooling temperature ranged between 1020° F. and 1130° F. and the cooling rate ranged between 15° F. per second and 27° F. per second. The optimum finish rolling temperature was about 1560° F.

Figure 6:
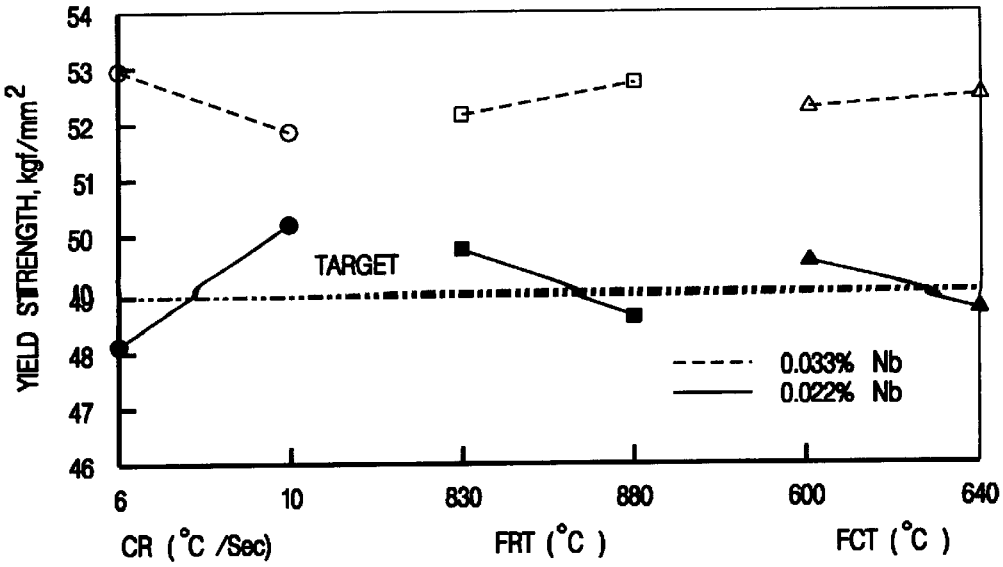
FIG. 6 is a graph based on laboratory-derived data that depicts the effects of niobium on yield strength and the effects of cooling rate, finish rolling temperature, and finish cooling temperature on yield strength for two levels of niobium.

When investigating niobium, two levels were evaluated with a base composition of 0.08% carbon, 0.82% manganese, 0.42% silicon, 0.36% copper, 0.21% nickel, 0.49% chromium, 0.074% vanadium, and 0.013% titanium. The niobium levels were 0.022% and 0.033%. FIG. 6 demonstrates that the 0.022% niobium did not always meet the minimum yield strength requirement of 49 kg/mm$^2$ (70 KSI). FIG. 6 also indicates that too low of a cooling rate will adversely affect the minimum yield strength. In addition, too high of a finish rolling temperature can also adversely affect the minimum yield strength as well as too high of a finish cooling temperature. Based on the FIG. 6 testing, optimum processing conditions are believed to be a finish rolling temperature of about 1530° F., a finish cooling temperature of about 1110° F. and a cooling rate of about 18° F. per second.

The laboratory/mill trials clearly demonstrate a method for making a low-carbon, more castable, weldable and formable, high toughness weathering grade steel in an as-rolled and cooled condition. Using the inventive method, a plate product can be made to meet several ASTM specifications in the as-rolled condition. More particularly, the A709-70 W Grade specification can be made in thicknesses up to 1.25" using controlled rolling and accelerated cooling. The ASTM specification A871-Grade 65 can also be met in thicknesses up to 1.5" using controlled rolling and accelerated cooling. The A709-50 W Grade specification can be met in thicknesses up to 3 to 4" using a controlled rolling and air-cooling, and/or accelerated cooling.

As such, an invention has been disclosed in terms of preferred embodiments thereof which fulfills each and every one of the objects of the present invention as set forth above and provides a new and improved method of making an as-rolled weathering grade steel plate and a plate product therefrom.

Of course, various changes, modifications and alterations from the teachings of the present invention may be contemplated by those skilled in the art without departing from the intended spirit and scope thereof. It is intended that the present invention only be limited by the terms of the appended claims.

TABLE 1

List of ASTM Specification for Weathering Bridge- and Pole-Building Applications

| ASTM Specification | Thickness Range | Processing | Typical C level | Applications | Characteristics |
|---|---|---|---|---|---|
| A588-Grade B | ≦4" | CFT/air[1] | 0.13–0.16% | Bridges, Poles | conventional medium strength, as-rolled steel |
| A709-Grade 50W-Type B | ≦4" | CFT/air[1] | 0.13–0.16% | Bridges | conventional medium strength, as-rolled steel |
| A871-Grade 65-Type II | by agreement | AR or Q&T[2] | 0.12% | Poles | conventional as-rolled or Q&T steel |
| A852 | ≦4" | HR/Q&T[3] | 0.12% | Structural | conventional Q&T, higher C steel |
| A709 70W | ≦4" | HR/Q&T[3] | 0.12% | Bridges | conventional Q&T, higher C steel |
| A709 HPS 70W | ≦4" | HR/Q&T[3] | 0.09% | Bridges | New Q&T, low-C HPS grade |

[1]CFT/air = Controlled Finish Temperature rolling and air cooling
[2]AR or Q&T = As-Rolled up to t ≦ ¾", Quenched-and-Tempered for t > ¾"
[3]HR/Q&T = Hot-Rolled and Quenched-and-Tempered
[4]CR/AC = Control Rolled and Accelerated Cooled

TABLE 2

Mechanical Property Requirements of Weathering Bridge-Building and Pole Steels

| ASTM Specification/ New Products | YS, ksi | TS, ksi | Elong. (in 2"), % | Longitudinal CVN Energy |
|---|---|---|---|---|
| A688-Gr B/A709 50W-Type B | ≧50 | ≧70 | 21 min | AASHTO Req.[1] |
| A871-Grde 65-Type II | ≧65 | ≧80 | 17 min | 15 ft-lbs @ −20° F. |
| A709 70W | ≧70 | 90–110 | 19 min | AASHTO Req.[1,2] |
| A709 HPS 70W | ≧70 | 90–110 | 19 min | AASHTO Req.[1,2] |

[1]AASHTO (American Association of State Highway and Transportation Officials) CVN toughness requirements for fracture-critical or fracture non-critical applications used in service temperature zones.
[2]The most stringent AASHTO requirement for 70W materials is the fracture-critical impact test for Zone 3 (minimum service temperature below −30 to −60° F.)

TABLE 3

Compositional Ranges For Current ASTM Weathering Steel Grades

| Steel | | C | Mn | P | S | Si | Cu | Ni | Cr | Mo | V | Al | N |
|---|---|---|---|---|---|---|---|---|---|---|---|---|---|
| A709-50W-B | min | | 0.75 | | | 0.15 | 0.20 | | 0.40 | | | | 0.01 |
| (A588-B) | max | 0.20 | 1.35 | 0.04 | 0.05 | 0.50 | 0.40 | 0.50 | 0.70 | | 0.10 | | |
| A871-65-H | min | | 0.75 | | | 0.15 | 0.20 | | 0.40 | | 0.01 | | |
| | max | 0.20 | 1.35 | 0.04 | 0.05 | 0.50 | 0.40 | 0.50 | 0.70 | | 0.10 | | |
| A709 70W | min | | 0.80 | | | 0.20 | 0.20 | | 0.40 | | 0.02 | | |
| (A852) | max | 0.19 | 1.35 | 0.035 | 0.04 | 0.65 | 0.40 | 0.50 | 0.70 | | 0.10 | | |
| A79 HPS 70W | min | | 1.15 | | | 0.35 | 0.28 | 0.28 | 0.50 | 0.04 | 0.05 | 0.01 | |
| | max | 0.11 | 1.30 | 0.020 | 0.006 | 0.45 | 0.38 | 0.38 | 0.60 | 0.08 | 0.07 | 0.04 | 0.015 |

TABLE 4

Compositions Of Weathering Steels According to Invention

| Steel | | C | Mn | P | S | Si | Cu | Ni | Cr | Mo | V | Nb | Ti | Al | N |
|---|---|---|---|---|---|---|---|---|---|---|---|---|---|---|---|
| Alloy A | 0.75 Mn | 0.08 | 0.76 | 0.020 | 0.010 | 0.42 | 0.29 | 0.29 | 0.51 | 0.013 | 0.080 | 0.034 | 0.014 | 0.044 | 0.0082 |
| Alloy B | 0.75 Mn | 0.09 | 0.74 | 0.017 | 0.009 | 0.43 | 0.26 | 0.30 | 0.52 | 0.011 | 0.080 | 0.035 | 0.014 | 0.045 | 0.0067 |
| Alloy C | 1.00 Mn | 0.08 | 0.98 | 0.017 | 0.009 | 0.43 | 0.31 | 0.29 | 0.52 | 0.012 | 0.086 | 0.034 | 0.013 | 0.039 | 0.0074 |
| Alloy D | 1.25 Mn | 0.08 | 1.26 | 0.017 | 0.009 | 0.42 | 0.24 | 0.28 | 0.52 | 0.011 | 0.078 | 0.034 | 0.014 | 0.043 | 0.0082 |
| Alloy E | 1.25 Mn | 0.08 | 1.26 | 0.017 | 0.010 | 0.42 | 0.31 | 0.28 | 0.52 | 0.011 | 0.082 | 0.032 | 0.013 | 0.038 | 0.0074 |

| Steel | $Ar_3$[1] | CI[2] | CE[3] | Pem[4] |
|---|---|---|---|---|
| Alloy A | 1473 | 6.78 | 0.37 | 0.186 |
| Alloy B | 1470 | 6.61 | 0.37 | 0.194 |
| Alloy C | 1440 | 6.84 | 0.41 | 0.199 |
| Alloy D | 1404 | 6.42 | 0.45 | 0.208 |
| Alloy E | 1401 | 6.81 | 0.45 | 0.212 |

[1]$Ar_3$: Austenite transformation start temperature on cooling
[2]CI: Corrosion Index (ASTM G101) = 26.01 Cu + 3.88 Ni + 1.20 Cr + 1.49 Si + 17.28 P − 7.29 (Cu)(Ni) − 9.1 (Ni)(P) − 33.39 $Cu^2$
[3]CE: IIW Carbon Equivalent = C + Mn/6 + (Cr + Mo + V)/5 + (Cu + Ni)/15
[4]Pem: Pem = C + Si/30 + (Mn + Cu + Cr)/20 + Ni/60 + Mo/15 + V/10 + 5B

TABLE 5

Summary of the Processing Parameters of Accelerated Cooled Plates According to Invention

| Plate t | Grade | Slab Reheat Temperature, ° F. | % Red. Below Int. T | Range of FRT, ° F. | Range of SCT, ° F. | Range of FCT, ° F. | Range of CR, ° F./sec |
|---|---|---|---|---|---|---|---|
| 0.5" | 0.75 Mn | 2300 | 60 | 1450 to | 1350 to | 950 to 1200 | 10 to 50 |
| | 1.00 Mn | | | 1650 | 1550 | | |
| | 1.25 Mn | | | | | | |
| 1" | 0.75 Mn | 2300 | 70 | 1450 to | 1400 to | 850 to 1270 | 8 to 35 |
| | 1.00 Mn | | | 1650 | 1550 | | |
| | 1.25 Mn | | | | | | |
| 1.5" | 0.75 Mn | 2300 | 60 | 1400 to | 1380 to | 900 to 1280 | 5 to 25 |
| | 1.00 Mn | | | 1600 | 1520 | | |
| | 1.25 Mn | | | | | | |

TABLE 6

Compositions of Mill Trials of 70W Grades

| Steel/Spec | | C | Mn | P | S | Si | Cu | Ni | Cr | Mo | V | Nb | Ti | Al | N |
|---|---|---|---|---|---|---|---|---|---|---|---|---|---|---|---|
| A709 HPS | min | | 1.15 | | | 0.35 | 0.28 | 0.28 | 0.50 | 0.04 | 0.05 | | | 0.01 | |
| 70W Spec. | max | 0.11 | 1.30 | 0.020 | 0.006 | 0.45 | 0.38 | 0.38 | 0.60 | 0.08 | 0.07 | | | 0.04 | 0.015 |
| Alloy X | | 0.09 | 0.79 | 0.012 | 0.006 | 0.38 | 0.33 | 0.27 | 0.49 | 0.005 | 0.066 | 0.041 | 0.014 | 0.03 | 0.0090 |
| Alloy Y | | 0.09 | 1.19 | 0.015 | 0.006 | 0.37 | 0.31 | 0.30 | 0.50 | 0.053 | 0.055 | 0.004 | 0.002 | 0.032 | 0.0090 |

We claim:

1. A method of making an as-rolled and cooled weathering grade steel plate comprising:

a) selecting a minimum yield strength:plate thickness target from one of 50 KSI:up to 4 inches, 65 KSI:up to 1.5 inches, and 70 KSI:up to 1.25 inches;

b) providing a heated shape consisting essentially of, in weight percent:
from about 0.05% to about 0.12% carbon;
from about 0.50% to about 1.35% manganese;
up to about 0.04% phosphorous;
up to about 0.05% sulfur;
from about 0.15% to about 0.65% silicon;
from about 0.20% to about 0.40% copper;
from greater than zero to up to about 0.50% nickel;
from about 0.40% to about 0.70% chromium;
from about 0.01% to about 0. 10% vanadium;
from about 0.01% to about 0.05% niobium;
from about 0.005% to about 0.02% titanium;
an amount of aluminum up to about 0.1%;
from about 0.001% to about 0.015% nitrogen;
with the balance iron and incidental impurities;

c) rough rolling the heated shape above the recrystallization stop temperature to an intermediate gauge plate;

d) finish rolling the intermediate gauge plate from an intermediate temperature below the recrystallization stop temperature to a finish rolling temperature above the $Ar_3$ temperature to produce a final gauge plate;

e) subjecting the final gauge plate to one of air or accelerated cooling when the minimum yield strength plate thickness target is 50 KSI:up to 4 inches, and liquid media accelerated cooling when the yield strength:plate thickness target is one of 65 KSI:up to 1.5 inches and 70 KSI:up to 1.25 inches, the air cooling having a start cooling temperature above the $Ar_3$ temperature, and the accelerated cooling having a start cooling temperature above the $Ar_3$ temperature, and finishing cooling temperature below the $Ar_3$ temperature.

2. The method of claim 1, wherein the manganese ranges between about 0.70% and 1.00%.

3. The method of claim 2, wherein the manganese ranges between about 0.70% and 0.90%.

4. The method of claim 1, wherein the niobium ranges between about 0.02% and 0.04%.

5. The method of claim 4, wherein the niobium ranges between about 0.03% and 0.04%.

6. The method of claim 1, wherein the titanium ranges between about 0.01% and 0.02%.

7. The method of claim 6, wherein the titanium ranges between about 0.010% and 0.015%.

8. The method of claim 1 wherein the manganese ranges between about 0.70% and 0.90%, the titanium ranges between about 0.01% and 0.02%, and the niobium ranges between about 0.02% and 0.04%.

9. The method of claim 1, wherein accelerated cooling is used and the composition of the heated slab and the accelerated cooling produce a discontinuous yielding effect in the cooled final gauge plate.

10. The method of claim 1, wherein a cooling rate for the accelerated cooling ranges between about 5 to 50° F./second for plate thicknesses ranging from 0.5 inches to up to 4 inches.

11. The method of claim 10 wherein the cooling rate ranges between 10 and 50° F./second for plates up to about 0.5 inches in thickness, 8 and 35° F./second for plates between about 0.5 inches and about 1.25 inches in thickness, 5 to 25° F./second for plates between about 1.25 inches and 1.5 inches in thickness, and 1 to 10° F. for plates up to about 4 inches.

12. The method of claim 1, wherein the accelerated cooling finish cooling temperature ranges between about 900° F. and 1300° F.

13. The method of claim 12 wherein the finish cooling temperature ranges between about 1000° F. and 1200° F.

14. The method of claim 1, wherein the start cooling temperature ranges from about 1350° F. to about 1600° F.

15. The method of claim 14, wherein the start cooling temperature ranges from about 1400° F. to about 1515° F.

16. The method of claim 1, wherein a 50 KSI: up to 4 inch target and one of air cooling or accelerated cooling is selected.

17. The method of claim 1, wherein a 70 KSI: up to 1.25 inch target and accelerated cooling are selected.

18. The method of claim 1, wherein a 65 KSI: up to 1.5" inch target and accelerated cooling are selected.

19. The method of claim 1, wherein the plate has a Corrosion Index per ASTM G101 of at least 6.0.

20. An as-rolled and cooled weathering grade steel plate made by the method of claim 1, the plate having a plate thickness of at least 1.25 inches and a minimum of 70 KSI yield strength.

21. An as-rolled and cooled weathering grade steel plate made by the method of claim 1, the plate having a plate thickness of at least 1.50 inches and a minimum of 65 KSI yield strength.

22. An as-rolled and cooled weathering grade steel plate made by the method of claim 1, the plate having a plate thickness of up to 4.0 inches and a minimum of 50 KSI yield strength.

23. An as-rolled and cooled weathering grade steel plate made by the method of claim 1, the plate having a Corrosion Index of at least 6.0 per ASTM G101.

24. The method of claim 1, wherein intermediate gauge plate is subjected to a rolling reduction percentage of 50–70% to make the final gauge plate.

25. A weathering grade steel composition consisting essentially of, in weight percent:
from about 0.05% to about 0.12% carbon;
up to about 0.04% phosphorous;
up to about 0.05% sulfur;

from about 0.15% to about 0.65% silicon;

from about 0.20% to about 0.40% copper;

from greater than zero up to about 0.50% nickel;

from about 0.40% to about 0.70% chromium;

from about 0.01% to about 0.10% vanadium;

from about 0.01% to about 0.05% niobium;

from about 0.005% to about 0.02% titanium;

an amount of aluminum up to about 0.1%;

from about 0.001% to about 0.015% nitrogen;

with the balance iron and incidental impurities.

26. The composition of claim 25, wherein carbon ranges between about 0.07 and 0.09%, manganese ranges between about 0.70 and 0.90%, titanium ranges between about 0.01 and 0.02, niobium ranges between about 0.03 and 0.04%, and vanadium ranges between about 0.06 and 0.09%.

* * * * *